US006270272B1

(12) United States Patent
Dunican, Jr. et al.

(10) Patent No.: US 6,270,272 B1
(45) Date of Patent: Aug. 7, 2001

(54) BINGO CROWN

(76) Inventors: David W. Dunican, Jr., 162 Chestnut St., West Springfield, MA (US) 01089; Domingos Joaquim, 120 Main St., Ware, MA (US) 01082

( * ) Notice: Subject to any disclaimer, the term of this patent is extended or adjusted under 35 U.S.C. 154(b) by 0 days.

(21) Appl. No.: 09/615,326

(22) Filed: Jul. 12, 2000

Related U.S. Application Data

(60) Provisional application No. 60/143,550, filed on Jul. 13, 1999.

(51) Int. Cl.[7] ..... B43K 23/04

(52) U.S. Cl. ..... 401/48; 401/131; 401/148; 401/193; D19/84

(58) Field of Search ..... 401/48, 131, 148, 401/193; 15/437; D19/84

(56) References Cited

U.S. PATENT DOCUMENTS

| | | | | |
|---|---|---|---|---|
| D. 293,891 | * | 1/1988 | Molvik et al. | D9/396 |
| D. 334,399 | * | 3/1993 | Ziegler | D18/15 |
| D. 353,623 | * | 12/1994 | Jones et al. | D19/88 |
| D. 376,620 | * | 12/1996 | Czapiewski | D19/42 |
| D. 381,042 | * | 7/1997 | Roche | D19/51 |
| D. 381,687 | * | 7/1997 | Skoko | D19/85 |
| 1,416,564 | * | 5/1922 | Lowe | 15/437 X |
| 2,362,992 | * | 11/1944 | Dentzler, Jr. | 401/48 |
| 3,241,482 | * | 3/1966 | Keck | 101/103 |
| 3,853,411 | * | 12/1974 | Ciraolo | 401/48 |
| 4,033,257 | * | 7/1977 | Funahashi | 101/111 |
| 4,121,719 | | 10/1978 | Wilhelm | 211/69.5 |
| 4,155,446 | | 5/1979 | Aronson | 206/45.14 |
| 4,680,864 | | 7/1987 | Heagerty | 33/26 |
| 5,037,224 | * | 8/1991 | Wright | 401/48 |
| 5,383,737 | * | 1/1995 | Urion | 401/48 |
| 5,411,344 | | 5/1995 | Gagne | 401/202 |
| 5,899,624 | * | 5/1999 | Thompson | 401/206 |

* cited by examiner

*Primary Examiner*—Gregory L. Huson
*Assistant Examiner*—Kathleen J. Prunner
(74) *Attorney, Agent, or Firm*—Richard C. Litman

(57) ABSTRACT

A crown or holder that is adapted for supporting a bingo dauber in a vertical marking position. The crown is twisted onto the end of the bingo dauber with the marking tip. The crown is adapted to receive the dauber in such a manner that when the crown is placed on a bingo card, the dauber is vertically disposed and the marking tip of the dauber is disposed just above the bingo card. A bingo player simply aligns the crown with a number and presses down on the dauber to mark the number imprinted on the bingo card below.

13 Claims, 3 Drawing Sheets

BINGO CROWN

CROSS-REFERENCE TO RELATED APPLICATION

This application claims the benefit of U.S. Provisional Patent Application Serial No. 60/143,550, filed Jul. 13, 1999.

BACKGROUND OF THE INVENTION

1. FIELD OF THE INVENTION

The present invention relates generally to bingo marking devices and more particularly, to a holder adapted for supporting a bingo dauber in a marking position.

2. DESCRIPTION OF RELATED ART

Comfortably and accurately marking a bingo card is essential to enjoying a game of bingo. Marking a bingo card requires repetitive movements and being able to easily and comfortably make those movements greatly reduces the stress on a player's wrist. Furthermore, while playing bingo, it is necessary for a bingo player either to hold the bingo dauber in his hand or to lay the bingo dauber on the bingo table nervously hoping that the dauber does not roll away at the most inopportune moment.

During a game of bingo, it is important that a participant remain focused on the numbers called and correctly marking his card as expeditiously as possible. It is equally as important that a bingo participant be relaxed and comfortable because if a player's wrist becomes fatigued from continuously holding a bingo dauber and from repeatedly having to turn his wrist every time a number is called, a player's ability to respond quickly and accurately is diminished.

The prior art describes a variety of marking devices and marking device holders, for example, U.S. Pat. No. Des. 293,891 issued on Jan. 1, 1988 to D.M. Molvik et al describes an ornamental design for a container used to hold a bingo card dauber. U.S. Pat. No. Des. 334,399 issued on Mar. 30, 1993 to W. F. Ziegler describes an ornamental design for an ink dauber. U.S. Pat. No. Des. 353,623 issued on Dec. 20, 1994 to H. J. D. Jones et al describes an ornamental design for a bingo clip board. U.S. Pat. No. Des. 376,620 issued on Dec. 17, 1996 to R. L. Czapiewski describes an ornamental design for a novelty paint-filled squeeze tube with an applicator tip.

An ornamental design for a bingo dauber bottle is described in U.S. Pat. No. Des. 381,042 issued on Jul. 15, 1997 to B. Roche. U.S. Pat. No. Des. 381,687 issued on Jul. 29, 1997 to J. M. Skoko describes an ornamental design for a rotating bingo dauber holder. U.S. Pat. No. 3,241,482 issued on Mar. 22, 1966 to H. P. Keck describes improvements in hand stamps. A rotary date stamp consisting of a plurality of date printers of an endless belt-like form which are rotatably hinge on a frame is described in U.S. Pat. No. 4,033,257 issued on Jul. 5, 1977 to T. Funahashi.

U.S. Pat. No. 4,121,719 issued on Oct. 24, 1978 to C. Wilhelm describes a holder for writing instruments which consists of a main body having at least two sockets for holding the writing end of a writing instrument. A container for both storing and displaying color markers is described in U.S. Pat. No. 4,155,446 issued on May 22, 1979 to G. L. Aronson. U.S. Pat. No. 4,680,864 issued on Jul. 21, 1987 to M. S. Heagerty describes a drawing guide for drawing straight lines, arcs, and straight lines at an angle to a base line. A safety marker pen for small children is described in U.S. Pat. No. 5,411,344 issued on May 2, 1995 to M. L. Gagne.

Although the prior art is replete with various types of marking devices and marking device accessories, the prior art does not describe any marking device or marking device adjunct with the unique features and function of the present invention. Therefore, there exists an unfulfilled need for an adaptation means that allows a bingo player to play bingo without worrying about accidentally or erroneously marking a bingo card. None of the above inventions and patents, taken either singly or in combination, is seen to describe the instant invention as claimed.

SUMMARY OF THE INVENTION

Accordingly, it is a principal object of the invention to provide a bingo dauber adjunct that allows a bingo player to quickly and accurately mark his or her bingo card.

It is another object of the invention to provide a bingo dauber adjunct or holder that eliminates the necessity for a bingo player to continuously hold a bingo dauber during a game of bingo.

It is a further object of the invention to provide a bingo dauber adjunct that eliminates the accidental and erroneous marking of a bingo card.

Still another object of the invention is to provide a bingo dauber adjunct that eliminates the ergonomic hardship on a bingo player of having to hold the bingo dauber in an awkward position and turning the wrist each time a number is called.

It is an object of the invention to provide improved elements and arrangements thereof in a bingo dauber adjunct for the purposes described which is inexpensive, dependable and fully effective in accomplishing its intended purposes.

The foregoing objectives are achieved in accordance with the present invention by providing a contoured bingo adjunct or holder or crown that fits over the tip end of a bingo dauber and allows the bingo dauber to be placed in a readied position over a bingo card. The bingo dauber crown of the present invention is easy to attach and remove from a bingo dauber. The bingo dauber crown is specifically designed to allow easy insertion and removal of a bingo dauber. A circular body portion defines a cylindrical cavity into which a bingo dauber is inserted. The walls of the circular body portion have symmetrically disposed thickenings that frictionally engage the body of a bingo dauber.

The crown of the present invention supports a bingo dauber in a vertical marking position. The crown holds a dauber in a vertical orientation with the marking tip disposed slightly above the bingo card. Therefore, the dauber is disposed in a ready-to-use position. A bingo player simply aligns the crown with a number and presses downwardly on the dauber to mark the number imprinted on the bingo card below. When the downward pressure on the dauber ceases, the dauber returns to its resting position with the marking tip disposed slightly above the bingo card.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
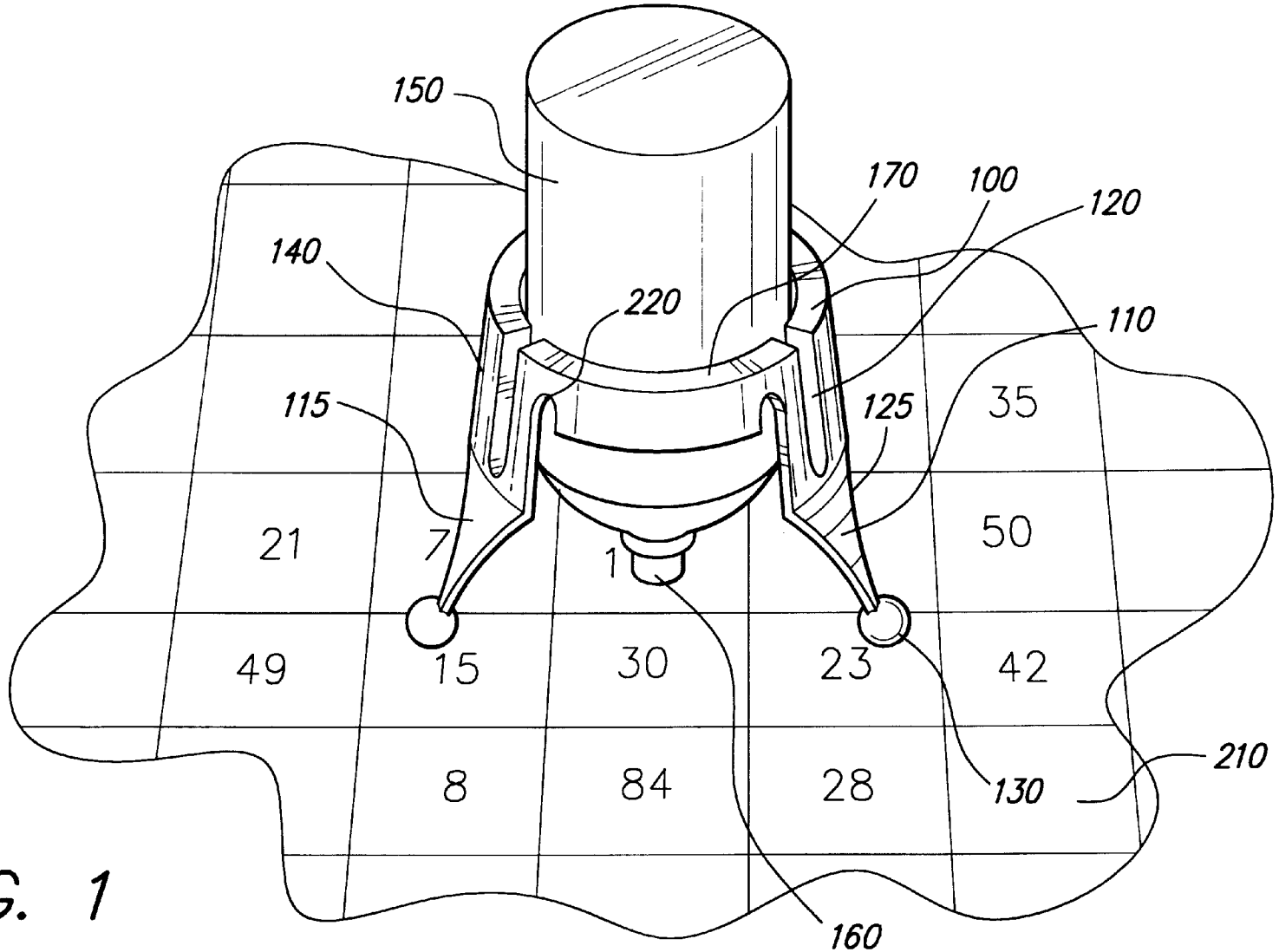
FIG. 1 is an environmental, perspective view of a bingo dauber fitted with a bingo crown marking a bingo card according to the present invention.

FIG. 1 shows an environmental, perspective view of a bingo dauber 150 disposed within a bingo dauber crown 100 that is aligned with a number on a bingo card 210. The dauber 150 is secured, within the cylindrical cavity 180 of the circular portion 170 of the crown 100 by three symmetrically and interiorly disposed thickenings 200 of the circular portion 170 of the crown 100. Three integrally formed elongated appendages (115, 125, 135) provide the crown 100 with a stable tripod configuration. Each appendage (115, 125, 135) comprises a substantially rectangular upper segment 140, a tapered middle segment 120, and a spherically shaped terminus 130. The upper segment 140 has a medially disposed elongated slot 110 that opens at the upper boundary of the circular portion 170 of the crown 100. Each interposed curved segment (170*a*, 170*b*, 170*c*) of the circular portion 170 has bilaterally disposed slots 220 that open at the lower boundary of the circular portion 170. The disposition of the slots (110, 220) and the contoured features of the middle segment 120 and the terminus 130 of the appendages (115, 125, 135) gives the crown 100 a distinctive appearance that is aesthetically appealing.

The crown 100 is placed on a dauber 150 by simply twisting the crown 100 onto the end of the dauber 150 with the marking tip 160. A bingo player aligns the crown 100 with a number on the bingo card 210 and exerts a downward force on the dauber 150 which causes the termini of the appendages (115, 125, 135) to move outwardly. The outward movement of the termini 130 and the downward vertical movement of the upper segment 140, the circular portion 170 of the crown 100, and the dauber 150 causes the tapered middle segment 120 to bow as the dauber 150 is applied to a bingo card 210. After the bingo card 210 has been marked and the downward force on the dauber 150 is no longer exerted by the bingo player, the tension in the bowed tapered middle segment 120 provides the restoring force to return the crown 100 to its resting position.

Figure 2:
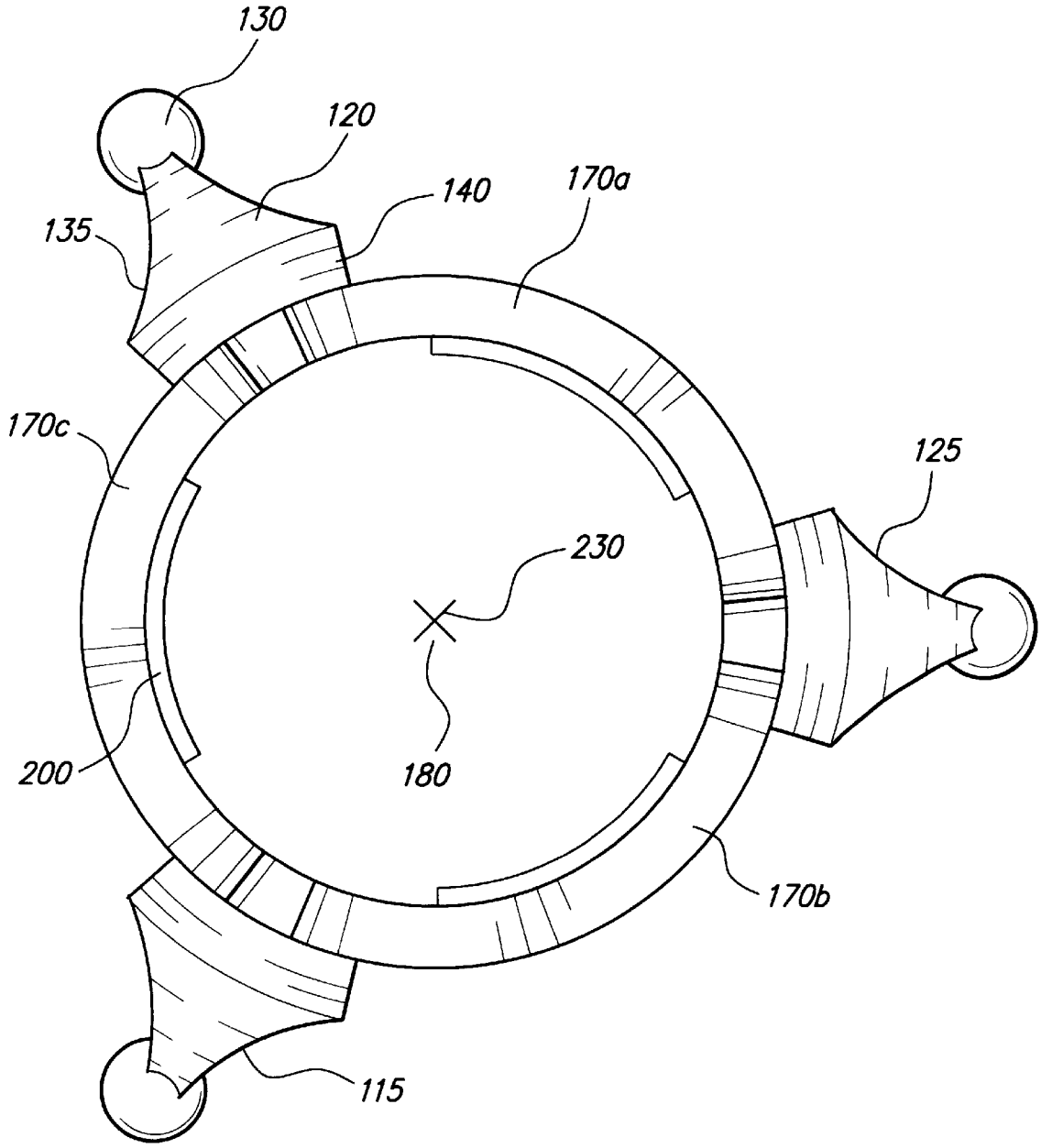
FIG. 2 is an axial view of the bingo crown showing the spatial relationship between the legs of the bingo crown.

FIG. 2 is an axial view of the bingo crown 100 along the central vertical axis 230 of crown 100 showing the spatial relationship between the appendages (115, 125, 135) of the crown 100. The appendages (115, 125, 135) are 120 degrees apart.

Figure 3:
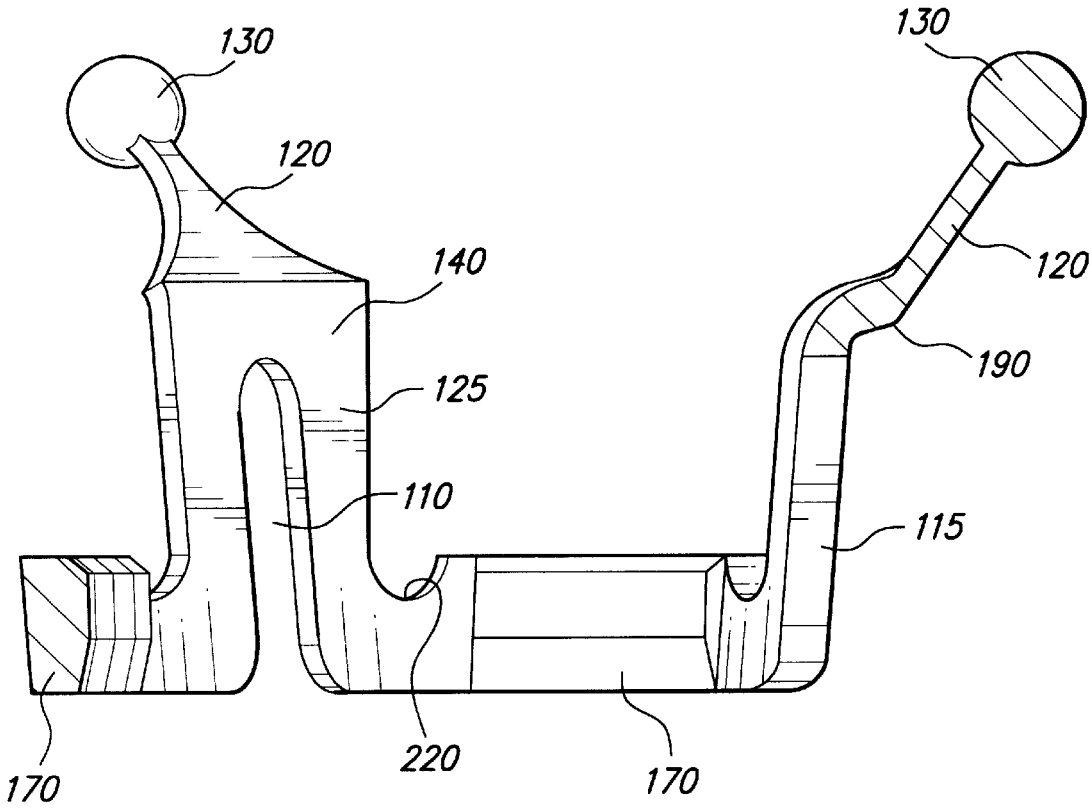
FIG. 3 is a cross-sectional view of the bingo crown showing the contoured bend of the leg, the crown being inverted.

FIG. 3 is a cross-sectional view of the bingo crown 100 showing the contoured bend 190 of the leg (115, 125, 135). The contoured bend 190 is where the upper segment 140 moves relative to the tapered middle segment 120 during the marking of a bingo card 210. In a preferred embodiment, the crown 100 has a height of 0.875 inches and an inner diameter of 0.860 inches. The circular portion 170 of the crown 100 has a height of 0.187 inches and a thickness of 0.063 inches except where the interior thickenings 200 are located. The contoured bend 190 is 0.562 inches from the upper boundary of the circular portion 170 of the crown 100. The contoured bend 190 is formed at a 45 degree angle relative to the central ventral axis 230 of the crown 100 and the lowest point of the spherically shaped termini 130 is 0.810 inches from the central vertical axis 230 of the crown 100.

The crown 100 may be made from plastic or metal. The crown 100 may be made in one piece by injection molding or any other process known in the art. The appendages 115, 125, 135 are flexible and resilient so that they may be compressed to lower the crown 100 when marking the card 210 and return to an upright position to raise the crown 100 and the dauber 150 above the card 210 after the compressive force is removed.

The bingo dauber holder or crown of the present invention enhances a bingo player's proficiency in the game of bingo and eliminates the stress and anxiety associated with accidental or erroneous marking of a bingo card. The crown also eliminates both the fatigue that results from having to constantly hold the dauber and the awkward twisting of the wrist to mark the bingo card. The crown of the present invention can be made of any suitable material, for example, a metal or a plastic.

The preferred embodiment of the present invention disclosed herein is intended to be illustrative only and is not intended to limit the scope of the invention. It should be understood by those skilled in the art that various modifications and adaptations of the present invention as well as alternative embodiments of the present invention may be contemplated. It is to be understood that the present invention is not limited to the sole embodiment described above, but encompasses any and all embodiments within the scope of the following claims.

We claim:

1. A holder adapted for a dauber comprising:

a circular body portion having a cylindrical cavity and symmetrically disposed interior thickenings; and a plurality of elongated appendages integrally formed with said circular body portion, each appendage having an upper segment, a tapered medial segment, and a spherically shaped terminus, the upper segment having a medially disposed slot defined therein.

2. The holder according to claim 1, wherein said body portion and said appendages are made of plastic.

3. The holder according to claim 1, wherein said body portion and said appendages are made of metal.

4. The holder according to claim 1, wherein said plurality of appendages comprises three appendages spaced apart at equal angles about said circular body portion in order to define a stable tripod base.

5. The holder according to claim 1, wherein each of said appendages is flexible and resilient so that said appendages may be compressed to lower said circular body portion and return to an upright position after being compressed.

6. The holder according to claim 1, wherein said circular body portion and said appendages are formed in a mold as a single piece.

7. The holder according to claim 1, wherein said circular body portion has an inner surface and further comprises said interiorly disposed thickenings being on said inner surface for holding a dauber.

8. A crown in combination with a dauber comprising:

said dauber having a cylindrical body and an end having a marker tip disposed thereon for applying a mark; and said crown comprising a circular body portion defining a cylindrical cavity and symmetrically disposed interior thickenings projecting into the cavity, said crown further comprising a plurality of elongated appendages formed integrally with the circular body portion, each said appendage having an upper segment, a tapered medial segment, and a spherically shaped terminus, the upper segment having a medially disposed slot defined therein.

9. The crown in combination with a dauber according to claim 8, wherein said body portion and said appendages are made of plastic.

10. A crown in combination with a dauber according to claim 8, wherein said body portion and said appendages are made of metal.

11. The crown in combination with a dauber according to claim 8, wherein said plurality of appendages comprises three appendages spaced apart at equal angles about said circular body portion in order to define a stable tripod base.

12. The crown in combination with a dauber according to claim 8, wherein each of said appendages is flexible and resilient so that said appendages may be compressed to lower said circular body portion and return to an upright position after being compressed.

13. The crown in combination with a dauber according to claim 8, wherein said circular body portion and said appendages are formed in a mold as a single piece.

* * * * *